US011987887B2

(12) United States Patent
Grolmes et al.

(10) Patent No.: US 11,987,887 B2
(45) Date of Patent: May 21, 2024

(54) METHOD FOR PASSIVATING METALLIC SUBSTANCES

(71) Applicant: Ewald DÖRKEN AG, Herdecke (DE)

(72) Inventors: Holger Grolmes, Erwitte (DE); Christopher Köster, Herdecke (DE); Ingo Klüppel, Bochum (DE); Marcel Roth, Düsseldorf (DE)

(73) Assignee: Ewald DÖRKEN AG (DE)

( * ) Notice: Subject to any disclaimer, the term of this patent is extended or adjusted under 35 U.S.C. 154(b) by 718 days.

(21) Appl. No.: 16/940,820

(22) Filed: Jul. 28, 2020

(65) Prior Publication Data

US 2021/0032757 A1 Feb. 4, 2021

(30) Foreign Application Priority Data

Jul. 29, 2019 (EP) ..... 19188901

(51) Int. Cl.
*C23C 22/30* (2006.01)
*C23C 22/06* (2006.01)
*C23C 22/34* (2006.01)

(52) U.S. Cl.
CPC ..... *C23C 22/06* (2013.01)

(58) Field of Classification Search
CPC ..... C23C 2222/10; C23C 22/30
See application file for complete search history.

(56) References Cited

U.S. PATENT DOCUMENTS 5,338,367 A 8/1994 Henriet
5,843,240 A * 12/1998 Pedrazzini ..... C23G 1/086 134/28
2010/0212542 A1* 8/2010 Nojima ..... C23C 22/74 106/14.44

FOREIGN PATENT DOCUMENTS

| | | |
|---|---|---|
| DE | 102006040908 | 3/2008 |
| EP | 3428314 | 1/2019 |
| JP | 2006013158 | 1/2006 |
| JP | 2009525398 | 7/2009 |
| JP | 2009249736 | 10/2009 |
| JP | 2010526206 | 7/2010 |
| KR | 900007534 | 6/1990 |
| WO | 1993014241 | 7/1993 |
| WO | 2004020700 | 3/2004 |

* cited by examiner

*Primary Examiner* — Lois L Zheng
(74) *Attorney, Agent, or Firm* — Edward E. Sowers; Brannon Sowers & Cracraft PC

(57) ABSTRACT

The present invention relates to a method for adjusting a passivation composition by determining the redox potential of a passivation composition as well as to a method for passivating metallic substrates by treatment with a passivation composition.

15 Claims, 4 Drawing Sheets

METHOD FOR PASSIVATING METALLIC SUBSTANCES

CROSS-REFERENCE TO RELATED APPLICATION

This application claims the benefit of European Application No. EP 19 188 901.3 filed on Jul. 29, 2019, and incorporates all by reference herein, in its entirety.

BACKGROUND OF THE INVENTION

The present invention relates to the technical field of passivating metallic substrates.

In particular, the present invention relates to a method for adjusting a passivation composition and a method for adjusting the color of a passivation composition or the color of a passivated metallic substrate. Furthermore, the present invention relates to a method for passivating metallic substrates.

Corrosion phenomena on metals are observed in all fields of technology and are of great importance, since the durability or service life of machines, vehicles, industrial plants or even buildings often depends to a decisive degree on the corrosion properties of the metals used. Corrosion leads to the consequence that metal parts have to be replaced or repaired, which is associated with an expenditure of time, material and costs. According to DIN EN ISO 8044, corrosion is the physicochemical interaction between a metal and its environment that leads to a change in the properties of the metal and can cause considerable impairment of the functions of the metal, the environment or the technical system of which the metal is a part. Corrosion of metals is usually an electrochemical process, namely the oxidation of metals by oxygen, possibly in the presence of an aqueous electrolyte solution.

Since corrosion processes often determine the durability or the service life of metals or metal components, it is necessary to reduce the susceptibility and rate of corrosion of metals. In order to protect metals from corrosion, passive systems—for example coatings such as protective lacquers or passivations—are used to protect the metal from environmental influences and thus from corrosion. On the other hand, active systems are used, in which the metal to be protected is protected by means of electrochemical processes. The metal to be protected acts as a cathode, which makes oxidation of the metal very difficult or reduces metal ions formed by reduction immediately back to the elemental metal.

This so-called cathodic corrosion protection can be achieved by applying an external voltage, however, it is also possible to bring the metal to be protected into electrical contact with a less noble metal, i.e. a metal with a lower electrochemical standard potential. The less noble metal is the anode compared to the more noble metal and is oxidized and constitutes the so-called sacrificial anode, while the more noble metal is the cathode where reduction takes place.

A special form of cathodic corrosion protection is the coating of components to be protected with a less noble metal. Of particular importance in this context is the galvanization, which is used in particular for the protection of steel components or steel sheets.

In galvanization, steel, in particular steel sheet, is usually coated with elemental zinc by immersion in baths of molten zinc in the so-called hot dip galvanization process, which results in hot dip galvanized steel sheets—also called HDGS (Hot Dip Galvanized Steel).

Another method for galvanizing large-area piece goods is galvanization or electrolytic galvanizing, in which steel sheets or steel components are coated with a zinc layer by applying an external voltage in an electrolytic bath containing zinc ions. In comparison to hot-dip galvanization, significantly more uniform and thinner layers can be obtained in this way.

Another possibility for galvanization is the use of zinc flake coatings, so-called zinc flake primers, in which flake-shaped zinc particles are dispersed in a binder matrix. Zinc flake coatings are often used for small parts or special components that have to meet special requirements, as they can be used, for example, as corrosion protection for connecting parts or threads due to the low layer thickness, the high mechanical strength and the low tolerance.

In particular hot-dip galvanization and electro galvanization are currently the usual methods for improving the corrosion protection of steel sheets or bulk goods. However, galvanization with elementary zinc or zinc alloys, as it is carried out in the course of hot-dip galvanization or electro galvanization, has the disadvantage that zinc or zinc alloys are rapidly corroded under oxidative conditions. Thus, on the one hand, the optical appearance of the coatings is impaired by the formation of soluble and insoluble zinc compounds, such as zinc oxide, zinc carbonate, zinc hydroxide, etc.—which are also called white rust—, and on the other hand, the durability of the cathodic corrosion protection layer is significantly reduced, for example under unfavorable climatic conditions such as the sea climate. In addition, the formation of white rust impairs the adhesion of other decorative or functional coatings applied to the zinc coating.

In order to increase the corrosion resistance of components coated with metallic zinc or zinc alloys, the galvanized components are usually subjected to conversion treatment or passivation, wherein the formation of a conversion or passivation layer significantly reduces the susceptibility to oxidation and thus the corrosion of the elementary zinc or zinc alloy. Other metallic surfaces, for example aluminium, titanium, steel, but also silver, are also protected against environmental influences, in particular corrosion, by passivation.

A passivation is usually understood to be the formation of an inorganic layer containing metal ions on the metal surface, which protects the underlying metallic surface from reactions, in particular from corrosion phenomena. The metal-oxide-containing passivation layer, which is only a few nanometers thick, can either be formed spontaneously by oxidation of the upper atomic layers of the metal surfaces or by a special chemical treatment. Examples of spontaneous oxidation are chromium and chromium-nickel steels with a chromium content of more than 12%, in which an inert chromium or chromium-nickel oxide layer is formed spontaneously by oxidation with atmospheric oxygen. The formation of the oxide layer can often be accelerated by treating the surface with acids or alkalis.

Furthermore, it is also possible to perform passivations by treating a metallic substrate or a metallic surface with special passivation compositions. These passivation compositions usually contain one or more transition metal compounds, which are deposited in the form of their oxides and/or hydroxides on the surface of the metallic workpiece or form mixed oxides and/or hydroxides with the metallic material of the substrate. In particular surfaces based on zinc, aluminium, cadmium or silver are passivated by treatment with special passivation compositions.

Chromating, which involves immersing the galvanized components in an acidic solution of chromium(VI) containing compounds, has proven to be a particularly efficient way of passivating and thus improving the corrosion protection of galvanized components, but also of surfaces based on aluminium, magnesium, cadmium and silver. As a result, a chromate layer is deposited on the zinc surface or metal surface, which passivates the surface and significantly reduces the susceptibility of the zinc or metal to corrosion. Due to the harmful effects of chromium(VI) compounds, passivations containing chromium are now preferably carried out only with chromium(III) compounds. However, this is often much more difficult to handle in terms of process engineering, as passivation baths and chromium(III) compounds are in principle less effective. For this reason, further additives often have to be added to the passivation composition and the service life of the passivation composition is very limited compared to chromium(VI) containing compositions.

However, a disadvantage in using passivation compositions, in particular in the case of chromium-containing passivations, is that the composition of the bath in which the metallic substrates are usually immersed for passivation changes over time. In particular, it is observed that the oxidation states of the used transition metal ions change, which on the one hand leads to an undesired color change of both the passivation composition and the passivated substrate, and on the other hand is accompanied by an undesired deterioration of the corrosion protection properties. The change or deterioration of the properties of the passivation baths leads to the need to renew or dispose of passivation baths which, however, comprise a share of metal ions which is basically high enough to enable efficient passivations. This causes an increased amount of potentially environmentally hazardous and costly to dispose passivation compositions, which could be avoided if the service life of the passivation composition could be extended.

A further possibility of corrosion protection, in particular of galvanized surfaces, is the treatment with phosphoric acid, the so-called phosphating, in which a metal phosphate layer is deposited on the metal surface.

Phosphating does not improve the corrosion resistance of a metal, in particular a metal coating, to the same extent as passivation, in particular chromating, but the resulting metal phosphate layer is a very good adhesion promoter for subsequent coatings.

It is already known that phosphating can be monitored and controlled by the redox potential of the phosphating solution, in particular when zinc phosphate or iron-zinc phosphate layers are to be deposited on iron or steel substrates.

DE 195 04 723 C2, for example, describes a method for phosphating metal sheets, in particular steel sheets, with solutions containing phosphate ions and zinc ions, which also comprise ozone. The ozone content and thus the proportion of iron(II) ions in the phosphating composition is monitored and controlled by measuring the redox potential of the phosphating solution.

Furthermore, EP 0 414 296 A1 relates to a method for phosphating iron or steel surfaces using low-zinc technology, wherein the content of peroxide or ferrous ions present in the phosphating solution is also monitored and controlled by measuring the redox potential of the phosphating solution.

Comparable approaches for passivations are not yet known.

Thus, there is still no method available in the state of the art which allows passivations to be carried out over a long period of time with constant quality without changing the color of the passivation compositions, the passivated substrate and the corrosion properties of the passivated substrate.

BRIEF SUMMARY OF THE INVENTION

An object of the present invention is therefore to provide a method for adjusting passivation compositions which makes it possible to adjust the properties of passivation compositions, such as the color of the passivated substrate or the corrosion protection, in a reproducible manner.

In addition, a further object of the present invention is to provide a method which enables the properties of passivation compositions to be kept constant or approximately constant during the use thereof, i.e. the corrosion protection properties of the passivation and/or the color of the passivated substrate must not change or only change minimally.

Furthermore, one object of the present invention encompasses the provision of a method which makes it possible to use passivation compositions significantly longer than previously possible, since in this way waste to be disposed of can be avoided and costs can be reduced.

Finally, it is a further object of the present invention to provide a method for passivating metallic substrates which enables a passivation of metallic substrates over a long period of time as uniformly and reproducibly as possible.

To solve the abovementioned objects, the present invention proposes a method according to the method claims; further advantageous embodiments of this aspect of the invention are provided.

Furthermore, subject-matter of the present invention is a method for adjusting the color of a passivation composition and/or for adjusting the color of a metallic substrate according to the current disclosure.

Finally, another subject-matter of the present invention is a method for passivating metallic substrates by treatment with a passivation composition as described herein; further advantageous embodiments of this aspect of the invention are also described.

It goes without saying that the particular features mentioned in the following, in particular special embodiments or the like, which are only described in relation to one aspect of the invention, also apply in relation to the other aspects of the invention, without this requiring any express mention.

Furthermore, for all relative or percentage, in particular weight-related, quantities or amounts stated below, it is to be noted that, within the framework of this invention, these are to be selected by the person skilled in the art in such a way that the sum of the ingredients, additives or auxiliary substances or the like always results in 100 percent or 100 percent by weight. This, however, goes without saying for the person skilled in the art.

In addition, the skilled person may deviate from the values, ranges or quantities listed below, depending on the application and individual case, without leaving the scope of this invention.

In addition, all of the parameters specified below or the like can be determined by standardized or explicitly specified determination methods or by common determination methods known per se by the person skilled in the art.

With this provision made, the subject-matter of the present invention is explained in more detail in the following.

DETAILED DESCRIPTION OF THE INVENTION

Figure 1:
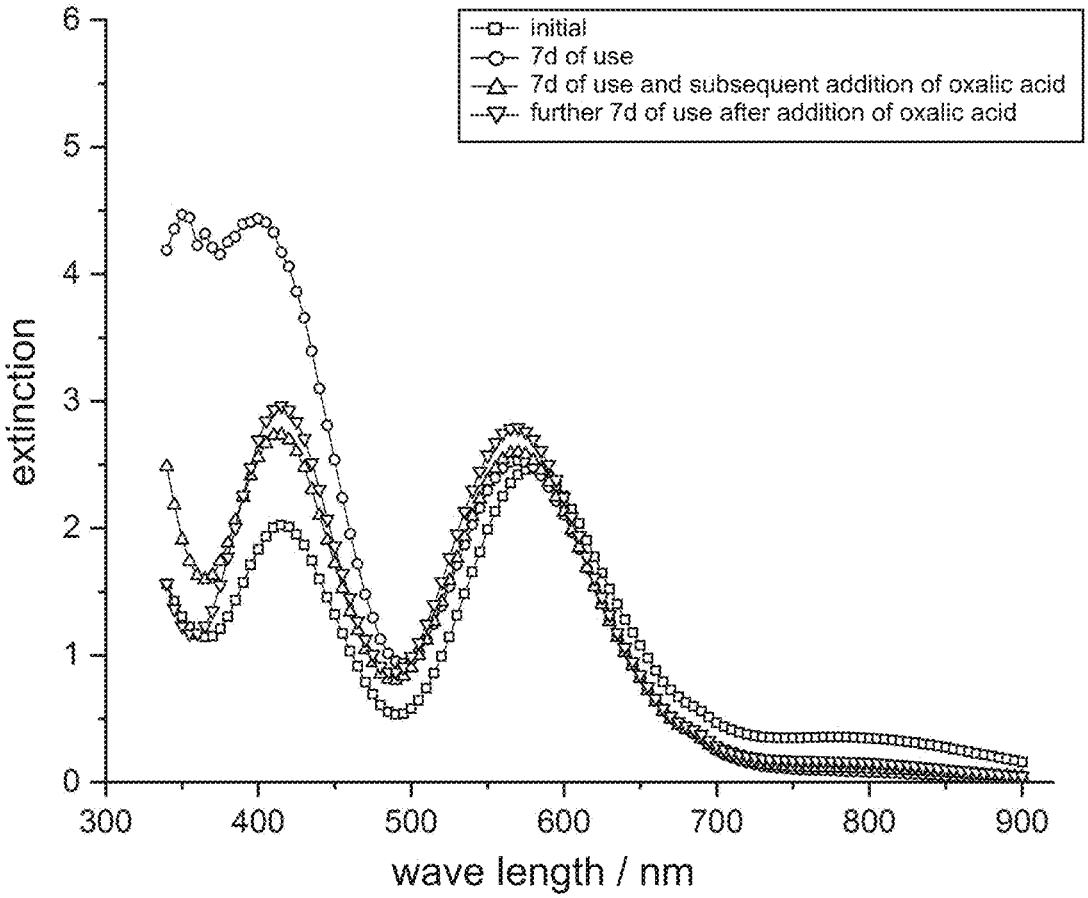
FIG. 1 provides UV-VIS spectra of the passivation composition according to example 1 in fresh state, after seven days of use and after addition of oxalic acid as reducing agent.

Subject matter of the present invention—according to a first aspect of the present invention—is a method for adjusting a passivation composition, comprising at least one ionic compound of a transition metal which can have several oxidation states, wherein the redox potential of the passivation composition is adjusted to predetermined values.

For, as has now been surprisingly found, the properties of passivation compositions containing transition metals can be adjusted directly depending on the redox potential of the passivation composition. This applies irrespective of the exact composition, i.e. which other components the passivation composition comprises, apart from the ions of a transition metal. However, the correlation of the properties of the passivation compositions, such as the color of the passivated substrate or the corrosion properties, and the redox potential of the passivation compositions need to be determined for each system. By specifically adjusting the redox potential, the properties of passivation compositions, in particular the color of the passivated substrate or the corrosion protection properties of the passivation, can be manipulated and adjusted in a targeted manner.

Furthermore, by monitoring and subsequent regulation or control of the redox potential of a passivation composition it is also possible to regenerate used passivation compositions and/or significantly extend the service life of passivation compositions.

By means of the inventive method for adjusting the passivation composition, it is in particular possible to provide passivations with constant color and corrosion protection properties over the entire service life of a passivation composition. Usually, the properties of the passivation composition and the resulting passivation change with increasing application time of the passivation composition: For example, the color of chromium-containing passivations on zinc surfaces changes from greenish at the beginning to yellowish in the course of application. These changes in the passivation can also be observed in the passivation compositions or passivation baths, whose colors change with increasing process duration. This is attributed—without wishing to be bound to this theory—to the oxidation and/or reduction of transition metal ions contained in the passivation composition, wherein the oxidation processes seem to predominate.

The redox potential of the passivation composition can be specifically adjusted or readjusted by the targeted addition of reducing agents or oxidizing agents, for example. In this way, the properties of freshly prepared passivation compositions can be manipulated in a targeted manner, and it is also possible to regenerate passivation compositions that have already been used or to extend the service life by continuously or discontinuously monitoring the redox potential of a passivation composition.

In the context of the present invention, a passivation composition is understood to be a diluted solution or dispersion, preferably a solution, on a usually aqueous basis, which contains chemical compounds in low concentrations which either react with the surface of a metallic substrate or can be deposited on the surface of a metallic substrate in order to form a passivation layer thereon. Passivation compositions are preferably acidic, i.e. comprise a pH value of well below 7.

In the context of the present invention, passivation or passivating means the formation of a passivation layer which is usually less than 200 nm thick and can be formed by insoluble metal compounds which are formed during the treatment with the passivation composition—also called conversion treatment—and additionally during pickling. In general, the insoluble metal compounds are metal oxides, in particular mixed metal oxides, but also fluorides, phosphates, etc. The passivation layer makes the metallic surface of a substrate inert, as the passage of electrons and thus reactions are made more difficult. Passivations within the scope of the present invention do not include in particular phosphatings in which metal phosphate layers are formed on metallic substrates. In the context of the present invention, passivation layers based on metal oxides are formed on metal surfaces during passivation.

In the context of the present invention, a metallic substrate is understood to be a surface or a body which comprises a metallic surface.

Particularly good results are obtained within the scope of the present invention if in the course of the inventive method (a) the redox potential of the passivation composition is determined, and (b) depending on the result of the measurement of the redox potential, the redox potential of the passivation composition is adjusted to predetermined values.

Thus, within the scope of the present invention, on the one hand, freshly prepared passivation compositions or passivation solutions can be adjusted in such a way that they comprise a (pre-)determined property profile. On the other hand, however, the redox potential can also be determined again at any time during the service life of a passivation composition and can be adjusted again to predetermined values in order to regenerate the passivation compositions or to extend the service life.

The most favorable redox potential or the redox potentials which correspond to the specific properties of a passivation composition must be determined individually for the respective system.

Within the scope of the present invention it is usually provided that the redox potential of the passivation composition is adjusted by adding reducing agents and/or oxidizing agents, preferably reducing agents. Surprisingly, the redox potential as well as the properties of the passivation composition can be adjusted, controlled and regulated by adding oxidizing agents or reducing agents.

As far as the passivation composition, which is used in the context of the present invention, is concerned, this is usually an aqueous-based passivation composition. In this context, particularly good results are obtained if the passivation composition has an acidic pH value.

As far as the pH of the passivation composition is concerned, the pH value can vary in a wide range. However, it has proven effective if the passivation composition has a pH value below 4, in particular below 3.5, preferably below 3.

Similarly, it may be provided that the passivation composition has a pH value in the range of 0 to 4, in particular 0.5 to 3, preferably 1 to 3, more preferably 1.8 to 2.8.

With pH values in the above-mentioned range, in particular pickling of the metallic surface is achieved so that the surface is made more susceptible to oxidation or to the formation or binding of metal oxides.

In addition, good results are generally obtained in the context of the present invention if the transition metal is selected from the group of vanadium, chromium, molybdenum, tungsten, manganese, iron ($Fe^{2+}/Fe^{3+}$), cobalt, nickel, cerium, titanium, zirconium and mixtures thereof. Particularly good results are obtained if the transition metal is selected from the group of vanadium, chromium, molybdenum, tungsten, manganese, iron ($Fe^{2+}/Fe^{3+}$), cobalt, nickel and mixtures thereof. In this context, it is particularly preferred if the transition metal is selected from the group of vanadium, chromium, molybdenum, tungsten, manganese, iron and mixtures thereof. The above-mentioned transition metals all comprise several oxidation states, in particular in aqueous solutions with an acidic pH value, so that they are particularly susceptible to a change in the redox potential. By adding reducing agents or oxidizing agents in particular, the redox potentials of the above-mentioned metals can also be specifically adjusted.

According to a preferred embodiment of the present invention, it is intended that the transition metal is selected from the group of vanadium, chromium, molybdenum, tungsten, manganese and mixtures thereof. Particularly good results are obtained if the transition metal is selected from the group of vanadium, chromium, manganese and mixtures thereof. In this context, it is particularly preferred if the transition metal is selected from the group of chromium, vanadium and mixtures thereof.

In the context of the present invention, the best results are obtained if passivation compositions are used which contain chromium(III) compounds and vanadium compounds, in particular vanadates.

Furthermore, it has been shown to be particularly advantageous in the context of the present invention if the passivation composition comprises chromium, in particular in the form of a chromium(III) compound, as transition metal. It has been found that particularly good results are obtained if the passivation composition contains chromium compounds. In addition to the chromium(III) compound, the other transition metals mentioned above may be present in the passivation composition used according to the invention, wherein it is particularly preferred if, in addition to chromium compounds, in particular chromium(III) compounds, at least one vanadium compound, in particular a vanadate, is contained in the passivation composition.

In this context, it has proven to be particularly beneficial if the passivation composition is free of chromium(VI) compounds, in particular chromates. Chromium(VI) compounds are all highly toxic and carcinogenic, so the use of these compounds should be avoided or at least minimized.

In addition, the present invention usually provides that the passivation composition is not a phosphating composition. As already explained above, a passivation within the scope of the present invention is not a phosphating composition. Although phosphates or phosphonates, in particular phosphoric acid or phosphonic acid or their respective derivatives, can also be used for passivation, passivations and passivation compositions are fundamentally different from phosphatings and phosphating compositions. The main difference between a passivation and a phosphatization is that in phospating a layer is applied to the substrate which is several micro meters thick and often serves as an adhesion promoter, whereas in passivation a thin layer, the so-called conversion layer, is produced with a thickness of less than 500 nm, in particular less than 200 nm.

As far as the concentration of the transition metal in the passivation composition is concerned, this can vary over a wide range. However, it has proven to be useful if the passivation composition contains the transition metal in amounts of 0.01 to 3 wt. %, in particular 0.03 to 1.5 wt. %, preferably 0.1 to 1 wt. %, more preferably 0.15 to 0.5 wt. %, particularly preferably 0.2 to 0.3 wt. %, based on the passivation composition. In the context of the present invention, therefore, highly diluted solutions are preferably used as passivation composition.

As mentioned above, it has been found to be particularly advantageous in the context of the present invention if the passivation composition contains chromium in the form of a chromium(Ill) compound. If the passivation composition contains a chromium(III) compound, the passivation composition—as also explained above—preferably contains at least one further transition metal, in particular in the form of a transition metal compound selected from the group of vanadium, molybdenum, tungsten, manganese and mixtures thereof, preferably vanadium, molybdenum and mixtures thereof, particularly preferably vanadium. Particularly good results are obtained in this connection if the passivation composition contains the other transition metal, in particular the other transition metal compound, in amounts of 0.01 to 0.15 wt. %, in particular 0.02 to 0.12 wt. %, preferably 0.04 to 0.1 wt. %, preferably 0.05 to 0.08 wt. %, based on the passivation composition. The total amount of transition metals or transition metal compounds preferably corresponds to the above-mentioned general ranges for the transition metal or transition metal compound.

If in the context of the present invention a reducing agent is used to adjust the passivation composition, the reducing agent is usually selected from the group of ascorbic acid, ascorbic acid derivatives, sulfites, dithionites, thiosulfates, hydrazine, aldehydes, citric acid, oxalic acid, oxalic acid derivatives and mixtures thereof. Particularly good results are obtained if the reducing agent is selected from the group of ascorbic acid, ascorbic acid derivatives, sulfites, thiosulfates and mixtures thereof.

In this context, ascorbic acid derivatives are preferably ascorbic acid esters and, with regard to the sulfites, dithionites and thiosulfates, preferably the alkali metal compounds, in particular the sodium compounds, i.e. sodium sulfite, sodium hydrogen sulfite, sodium disulfite, sodium dithionite, sodium thiosulfate are used.

As far as the use of the reducing agent is concerned, it has proven to be effective if the reducing agent is used in dissolved form, in particular in the form of an aqueous solution. In this regard, it has proven to be effective if the solution, in particular the aqueous solution, contains the reducing agent in amounts of 1 to 50 wt. %, in particular 2 to 30 wt. %, preferably 5 to 20 wt. %, based on the solution.

The use of reducing agents in an aqueous solution permits in particular a very rapid mixing of the reducing agent with the passivation composition and thus an almost instantaneous adjusting of the reduction potential of the passivation composition. Furthermore, in order to not unnecessarily dilute the passivation composition and change its properties, preferably relatively concentrated solutions of a reducing agent are used. It has been shown that in particular the adjustment of the redox potential with ascorbic acid, ascorbic acid derivatives, sulfites and thiosulfates is particularly fast, which is why the use of these reducing agents is preferred.

If, in the context of the present invention, an oxidizing agent is used, the oxidizing agent is usually selected from the group of hydrogen peroxide, peroxides, perborates, percarbonates, peroxo acids, hypochlorites, chlorates and mixtures thereof. Particularly good results are obtained when the oxidizing agent is selected from the group of hydrogen peroxide, peroxides, perborates, percarbonates, peroxo acids and mixtures thereof. If peroxides, perborates or percarbonates are used in the context of the present invention, these are usually used in the form of their alkali metal salts.

Within the scope of the present invention, it has furthermore proven to be advantageous if the oxidizing agent is used in the form of a solution, in particular in the form of an aqueous solution. In this context, particularly good results are obtained if the solution, in particular the aqueous solution, comprises the oxidizing agent in amounts of 1 to 50 wt. %, in particular 2 to 30 wt. %, preferably 5 to 20 wt. %, based on the solution.

As already mentioned in connection with the reducing agent, relatively concentrated solutions of the oxidizing agent are preferably used in order to not change the composition of the passivation composition, i.e. not to dilute the passivation composition too much. The application of the oxidizing agent in the form of solutions also has the advantage that the passivation composition is mixed very quickly and the redox potential can be changed and adjusted quickly.

According to a preferred embodiment of the present invention, the redox potential of the passivation composition is determined discontinuously, i.e. several times, or continuously, preferably continuously, during the service life of the passivation composition and adjusted to predetermined values. By means of a continuous or discontinuous determination of the redox potential of the passivation composition and subsequent adjusting of the redox potential to predetermined values, in particular by addition of reducing or oxidizing agents, the service life of passivation compositions can be significantly extended. In this way it is possible in particular to extend the service life of passivation compositions to more than twice, in particular more than three times, preferably more than four times, the service life normally provided for.

Furthermore, it is also possible that used passivation compositions, i.e. passivation compositions whose chemical composition has changed to such an extent that the color of the passivated substrates and/or the corrosion protection properties no longer meet the requirements, can be regenerated. With the method according to the invention, the waste produced, in particular the amount of passivation composition to be disposed of, can thus be significantly reduced.

As far as the determination of the redox potential is concerned, this can be achieved in many different ways. In particular it is possible within the scope of the present invention that the redox potential is determined directly or indirectly. In the case of a direct determination, the redox potential is usually measured, in particular by electrical measurement. An indirect determination of the redox potential can, for example, be carried out in colored systems by determining the color of the passivation compositions, in particular by measuring the absorption and/or transmission of electromagnetic radiation, in particular by photometry.

For an indirect determination of the redox potential via the coloration of the passivation composition, it is necessary that the coloration of the passivation composition, in particular the absorption and/or transmission of electromagnetic radiation, changes as a function of the redox potential. For this purpose, it is usually necessary that the passivation composition contains transition metal ions whose different oxidation states has different colors or which form colored complexes with other components of the passivation composition depending on the oxidation state. Particularly good results are obtained in this context if the passivation composition comprises manganese and/or vanadium ions. Particularly good results are obtained if the passivation composition contains vanadium ions. Vanadium has a plurality of different stable oxidation states with different colors in aqueous solution, so that passivation compositions with vanadium compounds are in particular suitable for photometric analysis and monitoring of the passivation composition.

If the redox potential is determined directly, in particular by means of an electrical measurement, the redox potential is preferably measured using an electrode, in particular a platinum electrode, relative to a reference electrode. The reference electrode can be any system familiar to the expert. In particular the reference electrode can be selected from the normal hydrogen electrode, a calomel electrode or a silver-silver chloride electrode. Due to the simple handling and good results that are reproducible and good even under industrial production conditions, it is preferred if the reference electrode is a calomel electrode or a silver-silver chloride electrode. However, the measuring procedures in this respect are familiar to the skilled person.

According to a preferred embodiment of the present invention, it is thus intended that the determination of the redox potential is carried out by means of an electrical measurement of the redox potential or a photometric determination or analysis of the passivation composition.

The figures show according to

Figure 2:
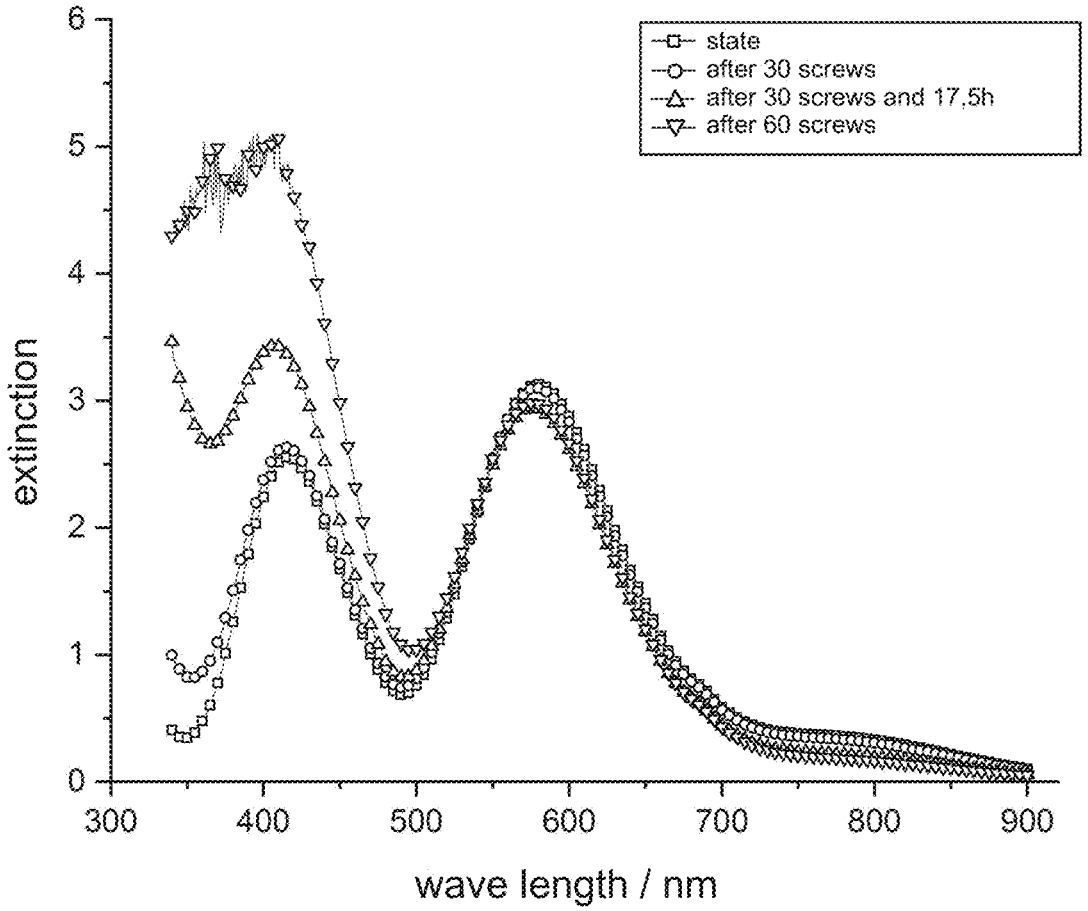
FIG. 2 provides UV-VIS spectra of the passivation composition according to example 2 in the freshly prepared state and after prolonged use and storage.
Figure 3:
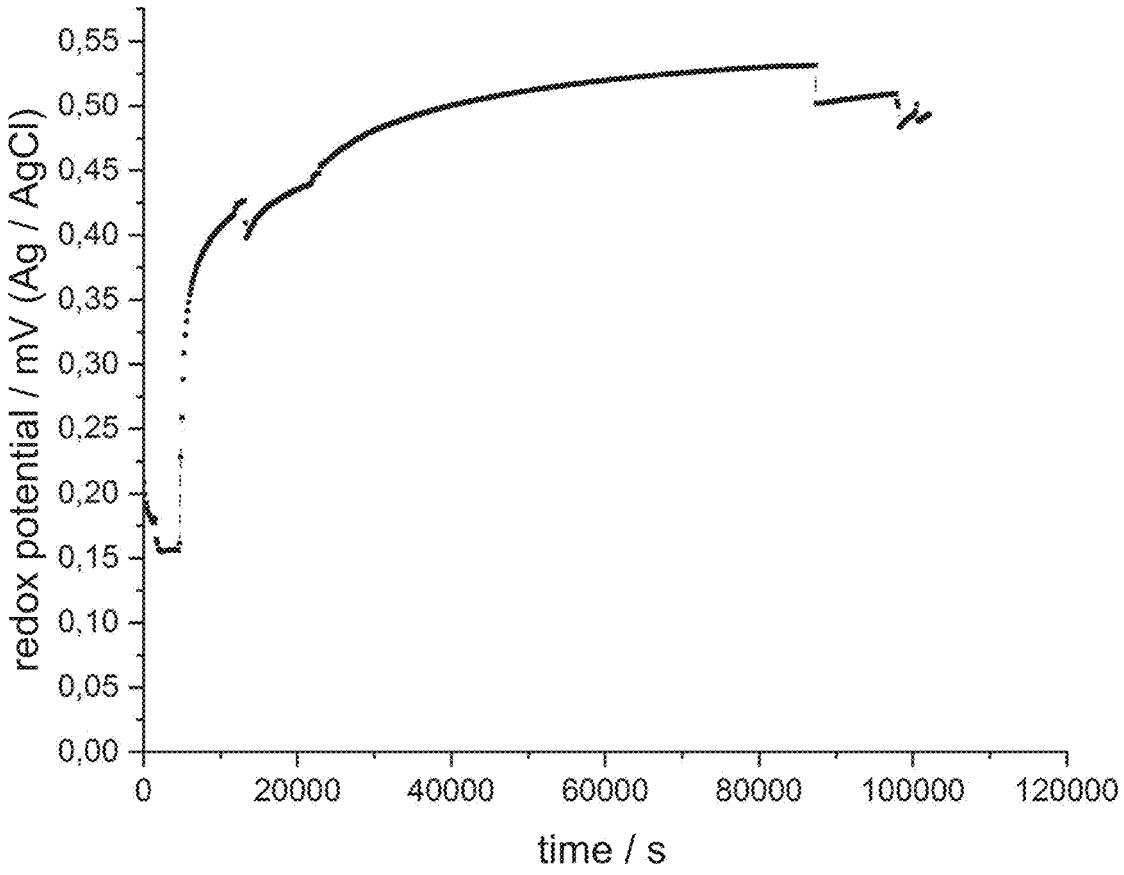
FIG. 3 illustrates the course of the redox potential of the passivation composition according to example 2 as a function of time.
Figure 4:
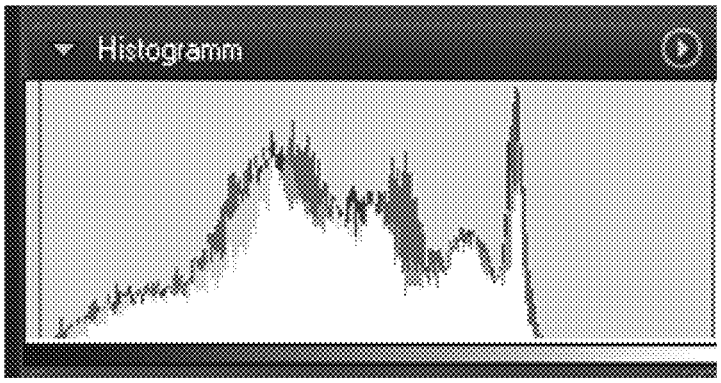
FIG. 4 provides the RGB histogram of the image of a screw coated with fresh passivation composition in example 3—corresponding to a redox potential of 445 mV.
Figure 5:
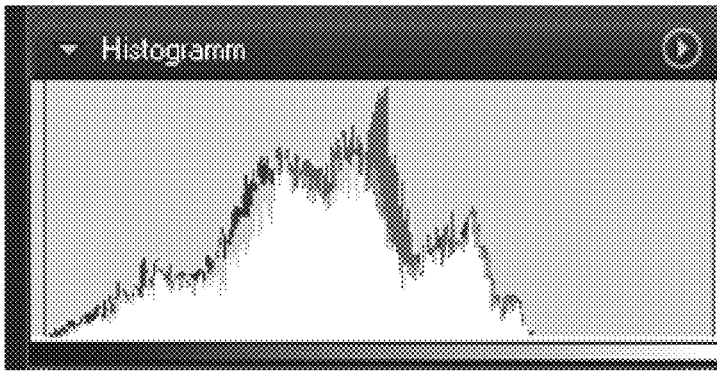
FIG. 5 provides the RGB histogram of the image of a composition coated in example with a used passivation composition—corresponding to a redox potential of 551 mV.
Figure 6:
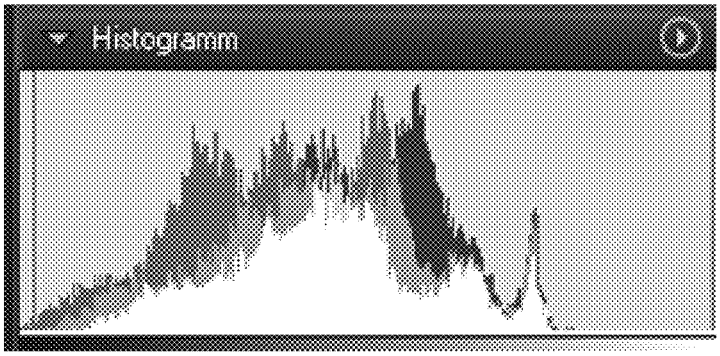
FIG. 6 provides the RGB histogram of the image of a screw coated in example 3 with a passivation composition with the addition of ascorbic acid, corresponding to a redox potential of the passivation composition of 197 mV.

FIG. 1 UV-VIS spectra of the passivation composition according to example 1 in fresh state, after seven days of use and after addition of oxalic acid as reducing agent;

FIG. 2 UV-VIS spectra of the passivation composition according to example 2 in the freshly prepared state and after prolonged use and storage;

FIG. 3 the course of the redox potential of the passivation composition according to example 2 as a function of time;

FIG. 4 the RGB histogram of the image of a screw coated with fresh passivation composition in example 3—corresponding to a redox potential of 445 mV;

FIG. 5 the RGB histogram of the image of a composition coated in example 3 with a used passivation composition—corresponding to a redox potential of 551 mV; and FIG. 6 the RGB histogram of the image of a screw coated in example 3 with a passivation composition with the addition of ascorbic acid, corresponding to a redox potential of the passivation composition of 197 mV.

Further subject matter of the present invention—according to a second aspect of the present invention—is a method for adjusting the color of a passivation composition and/or the color of a metallic substrate, comprising at least one ionic compound of a transition metal which can have several oxidation states, wherein (a) the redox potential of the passivation composition is determined, and (b) depending on the result of the measurement of the redox potential, the redox potential of the passivation composition is adjusted to predetermined values.

As already explained above, by adjusting the redox potential of passivation compositions which comprise transition metals with several oxidation states, in particular in the acidic pH range, both the color or tint of the passivation composition and of the passivated substrate can be selectively adjusted. In particular it is possible that the passivated substrate receives a constant color tone over the entire service life of the passivation composition, which creates a particularly high-quality impression for the customer.

For this particular embodiment of the method according to the invention, all previously mentioned special features, specific characteristics and advantages apply equally.

For further details on the method for adjusting the color of a passivation composition and/or the color of a metallic substrate according to the invention, reference is made to the above explanations on the first aspect of the invention, which apply accordingly to the method for adjusting the color of a passivation composition and/or the color of a metallic substrate according to the invention.

Again, further subject matter of the present invention—according to a third aspect of the present invention—is a method for passivating metallic substrates by treatment with a passivation composition, comprising at least one ionic compound of a transition metal which can have several oxidation states, wherein the redox potential of the passivation composition is adjusted to predetermined values.

As already explained above in connection with the explanations on the method for adjusting a passivation composition according to the invention or for adjusting the color of a passivation composition and/or the color of a metallic substrate, the properties of the passivation composition can be manipulated in a targeted manner by adjusting the redox potential of a passivation composition and a specific property profile of the passivation composition can be set. In particular the color of the passivated substrate or the corrosion protection properties of the passivated substrate can be changed or manipulated and adjusted.

In addition, by means of a continuous, in particular continuous or discontinuous, determination and adjusting of the redox potential of the passivation composition it is possible, on the one hand, to significantly extend the service life of passivation compositions and, on the other hand, to reliably guarantee a constant passivation quality.

Particularly good results are obtained in the context of the present invention if the method for passivating metallic substrates by treatment with a passivation composition, comprising at least one ionic compound of a transition metal which can have several oxidation states, is carried out in such a way that (a) the redox potential of the passivation composition is determined, and (b) depending on the result of the measurement of the redox potential, the redox potential of the passivation composition is adjusted to predetermined values.

Again, the determination and adjusting of the redox potential can be performed discontinuously, i.e. several times, or continuously during the service life of the passivation composition.

As far as the metallic substrate is concerned, the surface of the metallic substrate can consist of a variety of materials, as already explained above. However, particularly good results are obtained in the context of the present invention if the metallic substrate comprises a surface of iron, steel, aluminium, zinc or alloys thereof.

Particularly preferably, the metallic substrate comprises a surface of aluminium, zinc or alloys thereof, wherein surfaces of zinc or zinc alloys are particularly preferred. The zinc or zinc alloys are preferably galvanizations, which are protected against white rust by a passivation.

As far as the temperatures at which the treatment with the passivation composition is carried out are concerned, these can vary in a wide range. However, particularly good results are obtained in this context if the treatment with the passivation composition is carried out at temperatures in the range of 20 to 85° C., in particular 25 to 75° C., preferably 30 to 60° C.

In the context of the present invention it is usually intended that the metallic substrate is treated with the passivation composition for a duration of 0.1 to 300 seconds, in particular 0.5 to 200 seconds, preferably 1 to 120 seconds, more preferably 10 to 100 seconds, particularly preferably 30 to 80 seconds, most preferably 50 to 70 seconds. Such short treatment times are sufficient to produce a conversion or passivation layer of sufficient thickness, which is why the method according to the invention is also suitable for large-scale technical processes.

As far as the treatment of the substrate with the composition is concerned, this can be done in any suitable way. However, it has proven to be effective if the metallic substrate is treated with the composition by dipping, spraying, scraping or rolling, preferably dipping.

For further details on the method for passivating a metallic substrate according to the invention, reference is made to the other aspects of the invention above, which apply accordingly with respect to the method for passivating a metallic substrate according to the invention.

WORKING EXAMPLES

The inventive method for adjusting the optical properties or the redox potential of passivation compositions for the associated control of the properties of the resulting passivations is demonstrated below.

In the following experiments, acid or alkaline galvanized screws are used, which are galvanized at current densities of 1.5 A/dm$^2$. However, the method according to the invention can be used with any other substrates, in particular steel sheets, or other zinc surfaces, such as parts coated by strip galvanizing or by coating with zinc alloys.

The exact sequence of galvanization and passivation processes is shown in Table 1.

TABLE 1

Process sequence of electrogalvanization and passivation

| Process step | | | |
|---|---|---|---|
| Nr. | Description | Duration | Temperature |
| 1 | Alkaline hot degreasing | 15 min | 65° C. |
| 2 | Rinse | 30 sec | RT |
| 3 | Rinse | 30 sec | RT |
| 4 | Pickling HCl | 10 min | RT |
| 5 | Rinse | 30 sec | RT |
| 6 | Rinse | 30 sec | RT |

TABLE 1-continued

| Process sequence of electrogalvanization and passivation | | | |
|---|---|---|---|
| Process step | | | |
| Nr. | Description | Duration | Temperature |
| 7 | Electrolytic degreasing | 4 min | RT |
| 8 | Rinse | 30 sec | RT |
| 9 | Rinse | 30 sec | RT |
| 10 | Acid dip with 0.3% hydrochloric add | 30 sec | RT |
| 11 | Acid galvanization or alkaline galvanization | 30 min | 40° C. (acid) RT (alkaline) |
| 12 | Rinse | 30 sec | RT |
| 13 | Rinse | 30 sec | RT |
| 14 | Brightening with 1% nitric acid | 30 sec | RT |
| 15 | Rinse | 30 sec | RT |
| 16 | Passivation according to specific example | 60 sec | RT |
| 17 | Rinse | 30 sec | RT |
| 18 | Rinse | 30 sec | RT |
| 19 | Rinse | 30 sec | RT |

Example 1

A passivation solution according to example 3 of EP 2 907 894 A1 is used.

The passivation comprises the following composition:

| Compound | wt.-% |
|---|---|
| Chromium(III) sulphate (solution in $H_2O$, 20%) | 72.2 |
| Sodium nitrate | 15.8 |
| Sodium hydrogen fluoride | 2.8 |
| Citric acid | 2.8 |
| Nitric acid | 2.2 |
| Sodium vanadate | 1.8 |
| Sodium molybdate | 0.8 |
| Water | 2.5 |

The passivation solution is produced from the concentrate by dilution with water and contains the concentrate in 10 wt. %.

The passivation is carried out on a laboratory scale in a beaker. Twenty screws are passivated in the passivation solution every day and then UV-VIS spectra of the passivation solution are recorded with a HACH LANGE phtometer. In addition, the passivations are evaluated optically.

It is shown that at the beginning of the test series the passivation solution has a blue coloration and also the produced passivation layers shimmer blue. After some time the passivation solution turns yellow and also the passivation layers get a yellowish tint. In the recorded UV-VIS spectra, this can be seen by a considerable increase of the absorbance in the low wavelength range as shown in FIG. 1.

By adding oxalic acid as a reducing agent, the passivation solution turns blue again and the resulting passivation layers also shimmer blue again. In the UV-VIS spectra it can be seen that the curve returns to its original state, while neither the passivation solution nor the passivation layers obtained can be distinguished from the fresh passivation composition with the naked eye. Surprisingly, even after fourteen days, the passivation composition and the passivation layers obtained with it comprise optically the same qualities as freshly applied passivation compositions.

Example 2

A passivation composition according to example 3 of EP 2 907 894 A1, as described above, is used.

The passivation of the screws is carried out at room temperature in a laboratory galvanic unit with a bath size of approx. 30 liters.

The passivation composition is initially colored blue and also the first obtained passivation layers have a bluish color.

After thirty screws, a bath time of seventeen and a half hours, and after sixty screws, UV-VIS spectra of the passivation composition are recorded with a HACH LANGE photometer. In parallel, the redox potential is determined by means of a platinum electrode compared to a silver/silver chloride standard electrode. The results are shown in FIG. 2 and FIG. 3.

Even with the naked eye it can be seen that during the tests the passivation solution takes on a yellowish color and the passivation layers obtained also have a yellowish tint. This can be seen also from the UV-VIS spectra of the passivation solutions according to FIG. 2, which display a strong increase of the extension in the lower wave length range of less than 450 nm. Similarly, the redox potential curve shown in FIG. 3 depicts that the redox potential rises sharply initially and then runs against a limit value.

Example 3

A passivation composition according to example 3 of EP 2 907 894 A1, as described above, is used.

The passivation of galvanized screws is carried out on a laboratory scale in an 800 ml beaker. The redox potential of the passivation composition is measured continuously by means of a platinum electrode against a silver/silver chloride standard electrode, wherein the potential is adjusted and maintained at approx. 0.150 volts by adding the redox agent ascorbic acid.

It can be seen that both the passivation composition and the passivation layers produced with it comprise a constant bluish color, even at increased area throughput.

Example 4

In a further experiment, a passivation composition according to example 3c of EP 2 492 371 A1 was used.

First, a concentrate of the passivation solution with the following composition is prepared:

| Compound | Weigth [g] |
|---|---|
| Water | 589.5 |
| Chromium(III) chloride hexahydrate | 108.5 |
| Sodium fluoride | 38 |
| Vanadylsulfate hexahydrate | 17 |
| Sodium nitrate | 216 |
| Sodium sulfate | 31 |

The passivation solution is prepared by dilution with water from the concentrate and contains the concentrate in 35 wt. %.

The passivations are carried out continuously on a laboratory scale in an 800 ml beaker. The redox potential of the passivation composition is determined by means of a platinum electrode against a silver/silver chloride standard electrode. Photos are taken of screws treated with the freshly prepared passivation composition as well as with older passivation compositions and the RGB histograms obtained are evaluated: All coatings comprise a yellowish surface.

The potential of the passivation composition is then adjusted to approx. 200 mV against a silver/silver chloride standard electrode using ascorbic acid. The screws passivated with this passivation composition are bluish in color, and the RGB histogram of the photos taken also shows a much stronger blue color. Furthermore, corrosion tests were carried out in neutral salt spray tests on the passivated screws treated with the fresh passivation solution and the used passivation solution with ascorbic acid. The results are shown in the following table.

TABLE 2

Results of the salt spray test

| Batch | Voltage [mV] | Rust formation |
|---|---|---|
| Fresh passivation composition | 445 | First white rust after 48 h<br>First red rust after 168 h |
| Used passivation composition | 551 | Not determined |
| passivation composition with additional ascorbic acid | 197 | First white rust after 192 h<br>First red rust after more than 336 h |

The invention claimed is:

1. Method for adjusting a passivation composition for passivation of metallic substrates, the passivation composition including at least one ionic compound of a transition metal which can have several oxidation states, the method comprising:

determining a redox potential for the passivation composition, adjusting the redox potential of the passivation composition to a predetermined value depending on the determined redox potential, wherein the passivation composition includes chromium in the form of a chromium (III) compound as transition metal and at least one further transition metal selected from the group of vanadium, molybdenum, tungsten, manganese and mixtures thereof, and wherein the passivation composition has the form of a dilute aqueous solution or dispersion.

2. Method according to claim 1, characterized in that the redox potential of the passivation composition is adjusted by adding an agent selected from the group consisting of reducing agents, and oxidizing agents.

3. Method according to claim 1, characterized in that the passivation composition has an acidic pH value.

4. Method according to claim 2, characterized in that the reducing agent is selected from the group consisting of ascorbic acid, ascorbic acid derivatives, sulfites, dithionites, thiosulfates, hydrazine, aldehydes, citric acid, oxalic acid, oxalic acid derivatives and mixtures.

5. Method according to claim 4, characterized in that the reducing agent is applied as wherein the aqueous solution comprises the reducing agent in amounts of from 1 to 50 wt. %, based on the aqueous solution.

6. Method according to claim 2, characterized in that the oxidizing agent is selected from the group consisting of hydrogen peroxide, peroxides, perborates, percarbonates, peroxo acids, hypochlorites, chlorates and mixtures thereof.

7. Method according to claim 6, characterized in that the oxidizing agent is used in a form including an aqueous solution, wherein the aqueous solution comprises the oxidizing agent in amounts of from 1 to 50 wt. %, based on the aqueous solution.

8. Method according to claim 1, characterized in that the passivation composition is not a phosphating composition.

9. Method according to claim 1, characterized in that the passivation composition contains the transition metal in amounts of from 0.01 to 3 wt. %, based on the passivation composition.

10. Method according to claim 1, characterized in that the redox potential is determined discontinuously, during the service life of the passivation composition and is adjusted to predetermined values.

11. Method according to claim 1, characterized in that the redox potential is determined continuously, during the service life of the passivation composition and is adjusted to predetermined values.

12. Method for passivating a metallic substrate by treating the metallic substrate with a passivation composition, the passivation composition including at least one ionic compound of a transition metal which can have several oxidation states, the method comprising:

determining a redox potential for the passivation composition, adjusting the redox potential of the passivation composition to a predetermined value based on the redox potential determined, providing a metallic substrate for treatment, and treating the metallic substrate with the passivation composition, wherein the passivation composition includes chromium in the form of a chromium (III) compound as transition metal and at least one further transition metal selected from the group of vanadium, molybdenum, tungsten, manganese and mixtures thereof, and wherein the passivation composition has the form of a dilute aqueous solution or dispersion.

13. Method according to claim 12, characterized in that the metallic substrate comprises a surface of iron, steel, aluminum, zinc or alloys thereof.

14. Method according to claim 12, characterized in that the treatment with the passivation composition is carried out at a temperature in a range of from 20 to 85° C.

15. Method for adjusting the color of a passivation composition and/or the color of a metallic substrate treated therewith, the passivation composition including at least one ionic compound of a transition metal which can have several oxidation states, the method comprising:

providing a discolored passivation composition and/or a discolored metal substrate, determining a redox potential for a discolored passivation composition, adjusting the redox potential of the discolored passivation composition to a predetermined value depending on the determined redox potential to provide a passivation composition having an adjusted color and/or treating the discolored substrate with the passivation composition, wherein the passivation composition includes chromium in the form of a chromium (III) compound as transition metal and at least one further transition metal selected from the group of vanadium, molybdenum, tungsten, manganese and mixtures thereof, and wherein the passivation composition has the form of a dilute aqueous solution or dispersion.

* * * * *